US007199522B2

(12) United States Patent
Jang et al.

(10) Patent No.: US 7,199,522 B2
(45) Date of Patent: Apr. 3, 2007

(54) PLASMA DISCHARGE METHOD AND PLASMA DISPLAY USING THE SAME

(75) Inventors: Sang-Hun Jang, Yongin-si (KR); Hidekazu Hatanaka, Seongnam-si (KR); Young-Mo Kim, Suwon-si (KR); Seong-Eui Lee, Seongnam-si (KR); Xiaoqing Zeng, Yongin-si (KR); Kyung-Min Chung, Yongin-si (KR); Seung-Hyun Son, Hwaseong-si (KR); Gi-Young Kim, Chungju-si (KR); Hyoung-Bin Park, Seongnam-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 10/942,024

(22) Filed: Sep. 16, 2004

(65) Prior Publication Data

US 2005/0067959 A1 Mar. 31, 2005

(30) Foreign Application Priority Data

Sep. 17, 2003 (KR) ..... 10-2003-0064566

(51) Int. Cl.
*H01J 17/49* (2006.01)
*G09G 3/20* (2006.01)

(52) U.S. Cl. ..... 313/582; 345/55

(58) Field of Classification Search ..... 313/582; 345/55

See application file for complete search history.

(56) References Cited

U.S. PATENT DOCUMENTS

| | | | | |
|---|---|---|---|---|
| 5,683,836 | A * | 11/1997 | Deboer et al. | 430/7 |
| 6,517,400 | B1 | 2/2003 | Cho et al. | 445/24 |
| 6,737,806 | B2 | 5/2004 | Jeong | 313/584 |
| 6,853,136 | B2 * | 2/2005 | Kim et al. | 313/582 |
| 2001/0040536 | A1 * | 11/2001 | Tajima et al. | 345/55 |
| 2002/0050958 | A1 * | 5/2002 | Matthies et al. | 345/55 |
| 2002/0084751 | A1 * | 7/2002 | Kim | 313/582 |
| 2003/0122468 | A1 | 7/2003 | Cho et al. | 313/309 |
| 2004/0207324 | A1 * | 10/2004 | Fujitani | 313/582 |

OTHER PUBLICATIONS

Shiegeo Mikoshiba, "Plasma Displays", p. 2.*

* cited by examiner

*Primary Examiner*—Don Wong
*Assistant Examiner*—Angela M Lie
(74) *Attorney, Agent, or Firm*—Robert E. Bushnell, Esq.

(57) ABSTRACT

A plasma discharge method and a plasma display using the same. In the method, a sustain discharge uses a facing surfaces discharge and a surface discharge after an address discharge. The discharges occur in separate discharge areas, and priming particles generated by the discharges are exchanged. Thus, the stability and the efficiency of the sustain discharge increase, and a gap for the address discharge decreases to lower a breakdown voltage.

23 Claims, 7 Drawing Sheets

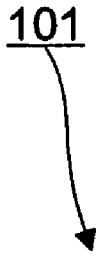
FIG. 2
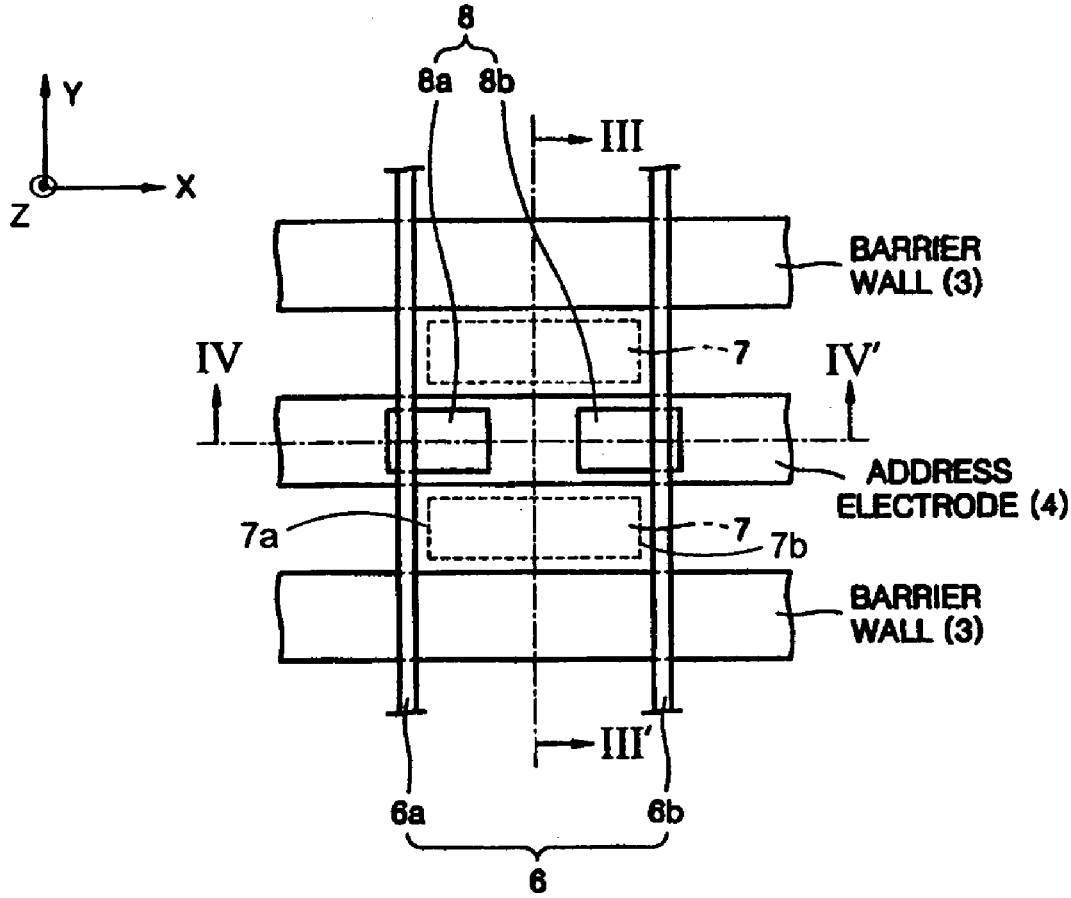

101

7a
6a
5a
7a
7b
7
7
1
16
6a
1a
8b
7b
6b
1b
x
y
z 6b
6a
7b
7
7a
1
AUXILIARY DISCHARGE
8b
MAIN DISCHARGE
8a
AUXILIARY DISCHARGE
7b
7
7a
z
x
y

PLASMA DISCHARGE METHOD AND PLASMA DISPLAY USING THE SAME

CLAIM OF PRIORITY

This application makes reference to, incorporates the same herein, and claims all benefits accruing under 35 U.S.C. §119 from an application for PLASMA DISCHARGE METHOD AND PLASMA DISPLAY USING THE SAME earlier filed in the Korean Intellectual Property Office on 17 Sep. 2003 and there duly assigned Serial No. 2003-64566.

BACKGROUND OF THE INVENTION

1. Field of the Invention

The present invention relates to a plasma discharge method and a plasma display using the same, and more particularly, to a plasma display having improved luminance and discharge efficiency by increasing a discharge gap.

2. Description of the Related Art

One of problems to be solved in a surface discharge type plasma displays is to reduce amount of light blocked by bus electrodes arranged in a front plate. In the surface discharge type plasma display, a couple of discharge electrodes corresponding to a unit discharge area are arranged in the front plate, and the discharge electrodes of the discharge areas are connected in serial by the bus electrodes. In general, the discharge electrodes are formed of a high resistant and transparent material, such as indium tin oxide (aka ITO), and the bus electrodes are formed of a low resistant and opaque material, such as a metal. Accordingly, since the bus electrodes of the plasma display located in an optical path absorb or block light, a luminance and an aspect ratio defined as the ratio of a optical transmission area to an entire screen area of the plasma display decreases.

U.S. Pat. No. 6,517,400 to Soo-Je Cho discloses a method of preventing deterioration of luminance by using opaque bus electrodes. In this method, the bus electrodes are formed as a tall and narrow multi-layer structures to reduce their width. However, the method requires complicated processes like laminating or plating metal films. Also, since the bus electrodes are narrow and tall, they can be easily damaged by an external force. Furthermore, as the height of the bus electrodes increases, the thickness of a dielectric layer increases, so that the transmission of visible rays decreases and a discharge turn-on voltage increases.

SUMMARY OF THE INVENTION

It is therefore an object of the present invention to provide an improved method for displaying images in a plasma display.

It is also an object of the present invention to provide an improved plasma display panel design that implements the improved method for displaying images.

It is further an object to provide a plasma display design that has a stable structure and can be easily manufactured.

It is still an object of the present invention to provide a plasma discharge method for a plasma display with a stable structure that is easy to manufacture.

It is also an object of the present invention to provide a plasma display with improved luminance, improved discharge characteristic, and improved efficiency, and a plasma discharge method for the same.

It is still an object of the present invention to provide a plasma display that uses a reduced address discharge voltage for inducing a main discharge, and a plasma discharge method for the same.

These and other objects can be achieved by a plasma discharge method to induce a gas discharge between a first plate and a second plate having a gas discharge area, the method including generating an address discharge by using a plurality of first and second sustain electrodes formed in the first plate and a plurality of address electrodes formed in the second plate and corresponding to the first and second sustain electrodes, generating a first sustain discharge in auxiliary discharge areas in the first plate by using a plurality of first and second bus electrodes, which are perpendicular to the first plate and have surfaces facing each other, and generating a second sustain discharge by the first and second sustain electrodes, which are formed in the first plate and respectively electrically connected to the first and second bus electrodes, with the first sustain discharge maintained.

The first sustain discharge and the second sustain discharge may occur at the same time after the address discharge is generated, and priming particles generated by the first sustain discharge and the second sustain discharge may help to improve the stability and efficiency of the second sustain discharge and the first sustain discharge respectively. Thus, the gap between the first plate and the second plate may be reduced to reduce an address discharge voltage. In other words, in the present invention, a stable and efficient plasma sustain discharge may occur due to facing surface discharge in an area (a well or recess) formed in the first plate and a surface discharge in a main discharge area between the first plate and the second plate. Such a stable and efficient sustain discharge reduces the gap between the first plate and the second plate, resulting in the decrease in a breakdown voltage of the address discharge between the sustain electrodes and the address electrodes, which are formed in the first plate and the second plate, respectively.

According to another aspect of the present invention, there is provided a plasma display having a first plate and a second plate defining a main discharge area in which a discharge gas is filled and a plurality of unit discharge areas corresponding to individual pixels are made and auxiliary discharge wells corresponding to the unit discharge areas, each well having a bottom, which is recessed from an inner surface of the first plate to a predetermined depth, and first and second walls, which face each other at both sides of the bottom of the auxiliary discharge well, a plurality of first and second bus electrodes arranged along the first and second walls, respectively, centering around the auxiliary discharge wells and having planes in perpendicular to the first plate, a plurality of first and second sustain electrodes corresponding to the unit discharge areas and formed on the inner surface of the first plate to have planes parallel with the inner surface of the first plate while being respectively electrically connected to the first and second bus electrodes, and a plurality of address electrodes formed in the second plate and corresponding to the first and second sustain electrodes.

The first plate may be a front plate that is capable of transmitting visible rays. A fluorescent layer may be formed on an inner surface of the second plate. First and second channels may be formed in the inner surface of the first plate so that the channels are in parallel with the first and second walls of the auxiliary discharge wells while being separated from the first and second walls by a predetermined distance, and the first and second bus electrodes may be arranged in the first and second channels in the first plate.

The first and second bus electrodes may be respectively connected to the first sustain electrodes and the second sustain electrodes of the unit discharge areas, which are arranged in the extending direction of the bus electrodes. The auxiliary discharge wells and the first and second channels may be formed in the first plate to a predetermined depth. The distance between the first wall and the second wall of the auxiliary discharge wells and the distance between the channels may be controlled to have a dielectric constant for maintaining the auxiliary discharge between the first and second bus electrodes. The bus electrodes may be formed of a metal having a low resistance, and the sustain electrodes may be formed of a transparent material, such as ITO.

Separate channels may be arranged in the first plate while being separated from the existing first and second channels by a predetermined distance, and the separate channels may be filled with a black matrix material for absorbing external light and preventing cross talks between pixels.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 2 is a layout illustrating a unit discharge area of the plasma display of FIG. 1;

DETAILED DESCRIPTION OF THE INVENTION

Figure 1:
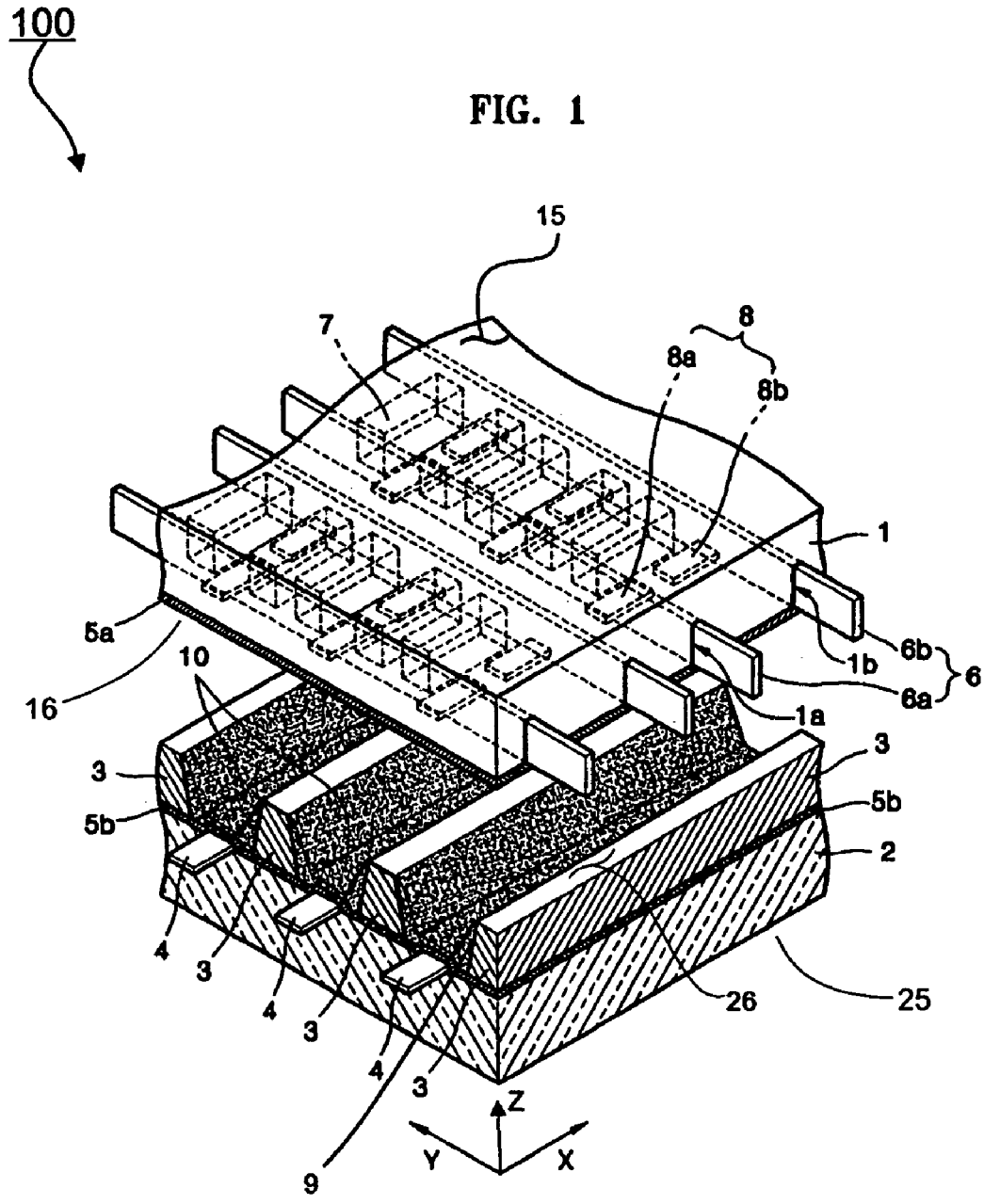
FIG. 1 is a perspective view illustrating a plasma display according to a first embodiment of the present invention.

FIG. 1 is a perspective view illustrating a plasma display 100 according to a first embodiment of the present invention, and FIG. 2 is a layout illustrating a unit discharge area 101 of the plasma display 100 of FIG. 1. Referring to FIGS. 1 and 2, a first plate (or front plate) 1 and a second plate (or rear plate) 2 are disposed parallel to each other and spaced apart from each other by a predetermined gap with barrier walls 3 in between and extending in the x direction. More specifically, the first plate 1 has an outer surface 15 and an inner surface 16. Second plate 2 has an outer surface 25 and an inner surface 26. The inner surface 26 of second plate 2 faces the inner surface 16 of first plate 1.

A fluorescent layer 9 is coated on the surfaces of the barrier walls 3 and on portions of the second plate 2 that remain exposed between the barrier walls 3. Address electrodes 4, being made of a metal or a metal paste, are located between the barrier walls 3 and under the fluorescent layer 9. The address electrodes 4 are protected by a second dielectric layer 5*b* formed on top of the address electrodes 4.

A first dielectric layer 5*a* is coated on the inner surface 16 of the first plate 1. First bus electrodes 6*a* and second bus electrodes 6*b* are formed in first plate 1 and are made of a metal or a metal paste and extend in a y direction in the first plate 1. Here, the first and second bus electrodes 6*a* and 6*b* form bus electrode pairs (or couples) 6. First sustain electrodes 8*a* and second sustain electrodes 8*b* form discharge sustain electrode pairs (or couples) 8 and are electrically connected to the first and second bus electrodes 6*a* and 6*b*, respectively. The sustain electrodes 8*a* and 8*b* are also formed in the first plate 1. The sustain electrode pairs 8 are formed of a transparent material, such as indium tin oxide (aka ITO). In addition, auxiliary discharge wells 7 are formed in first plate 1 and extend in the x direction at both sides of the sustain electrode couples 8.

As illustrated in FIG. 1, the first and second bus electrodes 6*a* and 6*b* are buried in the first plate 1. More specifically, the first and second bus electrodes 6*a* and 6*b* are filled in first and second channels 1*a* and 1*b* that are formed in the first plate 1 to a predetermined depth. These channels are formed to be deep inside (in a z direction) first plate 1 but occupy only a small amount of surface area (i.e., are narrow in the x direction) on inner surface 16. Thus, when these channels are filled with conductive material to form the bus electrodes 6, very little light is blocked by these bus electrodes 6 but bus electrodes 6 have a large enough cross-sectional area so that the resistance of bus electrodes is small. Accordingly, the first and second bus electrodes 6*a* and 6*b* stand in perpendicular (in the z direction) to the first plate 1 and in the first plate 1. Thus, the planes of the first and second bus electrodes 6*a* and 6*b* face each other and are spaced apart from each other in the x direction.

The auxiliary discharge wells 7 are formed between the first and second bus electrodes 6*a* and 6*b* to a predetermined depth in first plate 1. The auxiliary discharge wells 7 have first and second walls 7*a* and 7*b* corresponding to the first and second bus electrodes 6*a* and 6*b*. Here, the walls 7*a* and 7*b* are portions of the first plate 1 while having a predetermined dielectric constant. The first and second bus electrodes 6*a* and 6*b* are capacitive combined centered around walls 7*a*and 7*b*of the auxiliary discharge wells 7 in which a discharge gas will be placed. Thus, an AC gas discharge occurs in the auxiliary discharge wells 7 by using a proper voltage. In other words, the first and second bus electrodes 6*a* and 6*b* are arranged at both sides of the auxiliary discharge wells 7, so that predetermined electric fields are formed in the auxiliary discharge wells 7. Since the discharge in the auxiliary discharge wells 7 occurs by applying voltages to the first and second bus electrodes 6*a* and 6*b* that face each other, the discharge in the auxiliary discharge wells 7 is a facing surface discharge type of a long gap between the first and second bus electrodes 6*a* and 6*b* whose gap is larger than the gap between the first and second plates 1 and 2. The first and second sustain electrodes 8*a* and 8*b*, which are connected to the first and second bus electrodes 6*a* and 6*b* and formed in the first plate 1, generate the discharge of a surface discharge type in auxiliary discharge wells 7.

Technical features of a plasma discharge method according to the present invention and a plasma display using the method are as follows. A facing surface discharge and a surface discharge occur at the same time. In addition, such discharges occur in different locations. More specifically, a first sustain discharge, defined as the facing surfaces discharge, occurs in the auxiliary discharge wells 7 formed in the first plate 1. A second sustain discharge, defined as the surface discharge, occurs in a main discharge area 10 between the first plate 1 and the second plate 2. The auxiliary well 7 and the main discharge area 10 are connected to each other allowing priming particles generated from one discharge to mix with and help the other discharge. Since the bus electrodes 6*a* and 6*b* extend in a direction perpendicular (in a z direction) to the plate 1, the width of the bus electrodes 6*a* and 6*b* are narrow and thus the bus electrodes block only a very small amount of generated light. Accordingly, the structure and orientation of the bus electrodes 6*a* and 6*b* is efficient in reducing the optical loss caused by the bus electrodes 6*a* and 6*b*.

Figure 3:
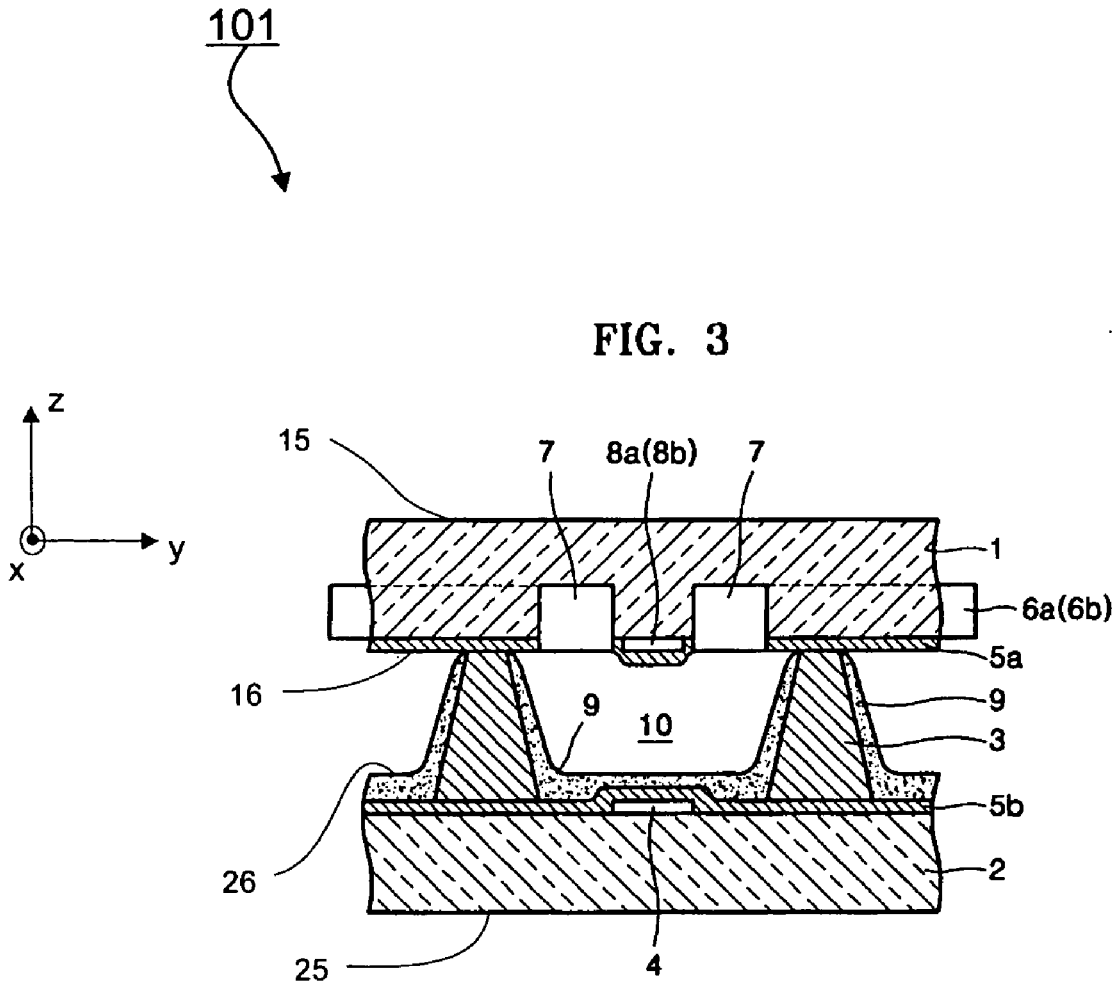
FIG. 3 is a cross-sectional view of the unit discharge area of FIG. 2 taken along line III–III'.
Figure 4:
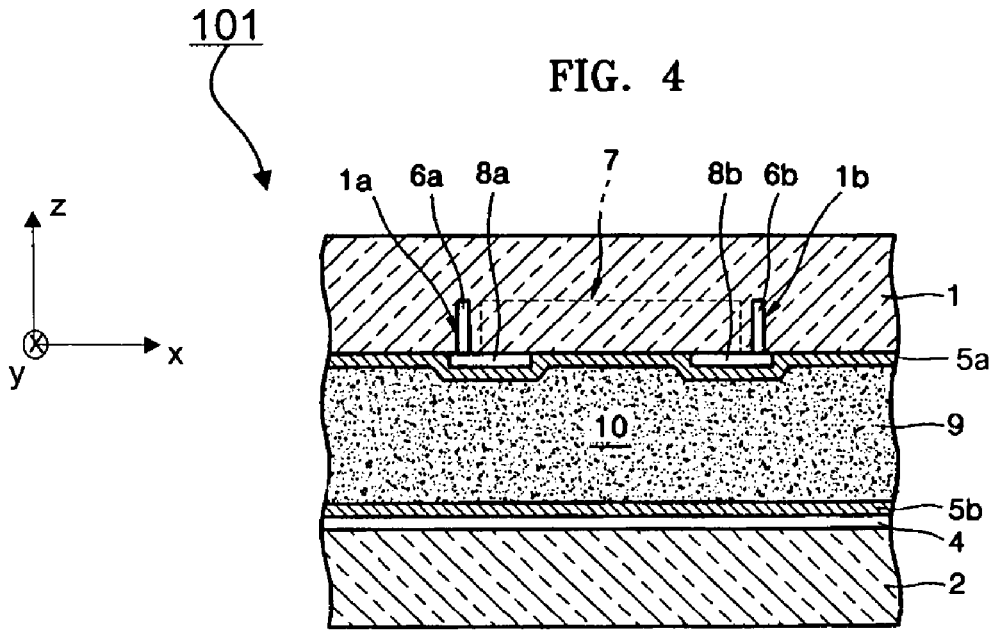
FIG. 4 is a cross-sectional view of the unit charge area of FIG. 2 taken along line IV–IV'.
Figure 5:
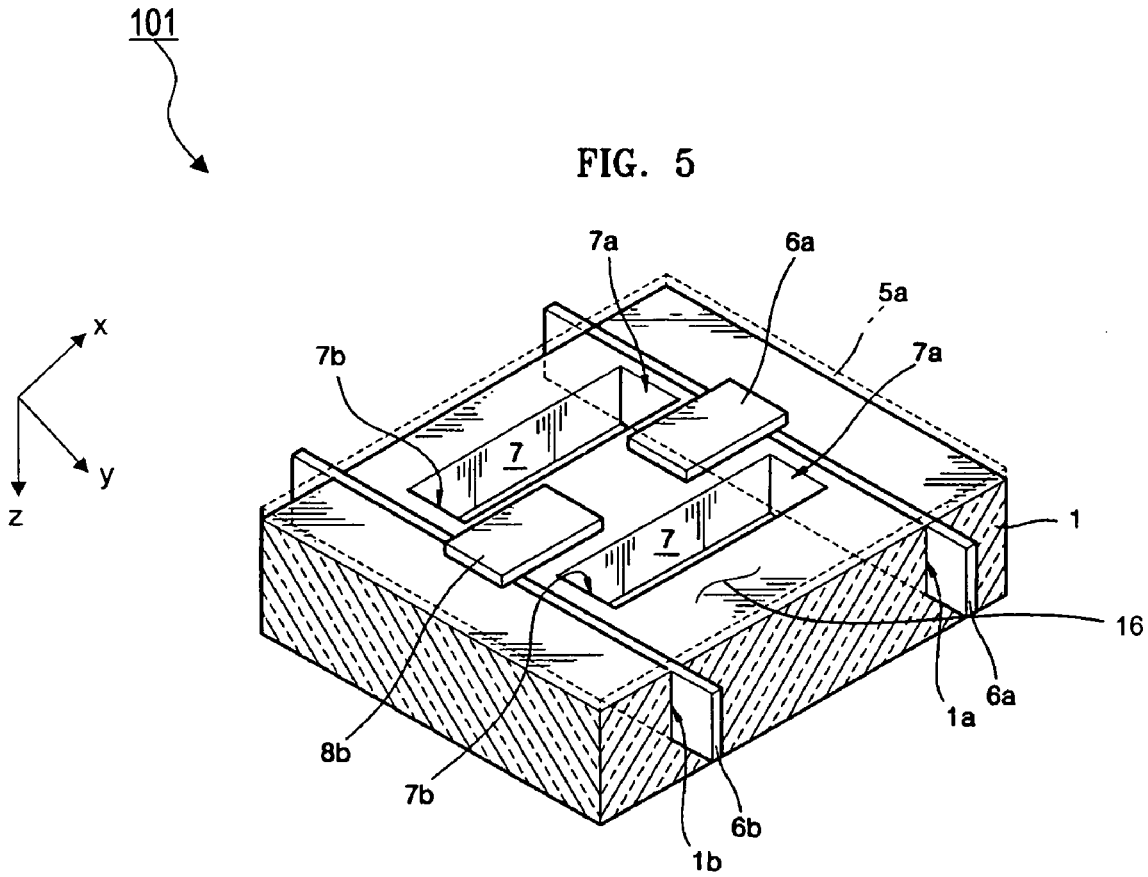
FIG. 5 is a perspective view illustrating a portion of a front plate of a plasma display according to the first embodiment of the present invention.

Turning now to FIGS. 3 through 5, FIG. 3 is a cross-sectional view of the unit discharge (or pixel) area 101 of FIG. 2 taken along line III–III', and FIG. 4 is a cross-sectional view of the unit discharge area 101 of FIG. 2 taken along line IV–IV' and FIG. 5 is a perspective view illustrating first plate 1 for a unit discharge area 101. Referring to FIGS. 3 through 5, two auxiliary discharge wells 7 are symmetrically located in each unit discharge area 101 and the first and second sustain electrodes 8*a* and 8*b* are located between pairs of auxiliary discharge wells 7 with a predetermined gap. The sustain electrodes 8*a* and 8*b* are electrically connected to the first and second bus electrodes 6*a* and 6*b*, which extend in perpendicular to (i.e., in the y direction) the arranged direction of the sustain electrodes 8*a* and 8*b* (x direction). In addition, the first and second sustain electrodes 8*a* and 8*b* are covered by the first dielectric layer 5*a*, and the main discharge area 10 is located under the first and second sustain electrodes 8*a* and 8*b*. The fluorescent layer 9 is located on the sidewalls of the barrier walls 3 and on the inner surface 26 of the second plate 2 between neighboring barrier walls 3 and underneath the main discharge area 10. The address electrode 4 induces the address discharge with any one of the sustain electrodes 8*a* and 8*b*. Address electrode 4 is located under the fluorescent layer 9, and the address electrode 4 is protected by the second dielectric layer 5*b* located under the fluorescent layer 9.

Figure 6:
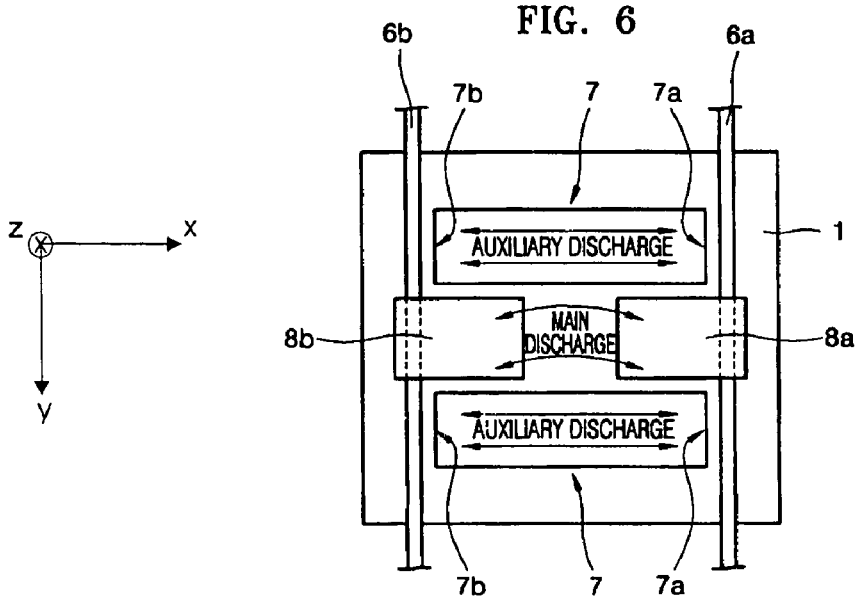
FIG. 6 is a plan view illustrating a plasma discharge method in a front plate of a plasma display according to the first embodiment of the present invention.

Turning now to FIG. 6, FIG. 6 is a plan view illustrating the plasma discharge method and a plasma display using the same according to the first embodiment of the present invention. As shown in FIG. 6, the auxiliary discharge occurs in the auxiliary discharge wells 7 by the first and second bus electrodes 6*a* and 6*b* that are located at the outside of the first and second walls 7*a* and 7*b* of the wells 7. Such an auxiliary discharge occurs in both auxiliary discharge wells 7 that have a long discharge gap. On the other hand, a main discharge occurs underneath the first plate 1 in main discharge area 10 and between the first and second sustain electrodes 8*a* and 8*b*. The auxiliary discharge and the main discharge occur in different areas. However, auxiliary discharge well 7 and the main discharge area 10 are connected, resulting in exchanging priming particles that are generated by the discharges resulting in stable and efficient discharges.

Figure 7:
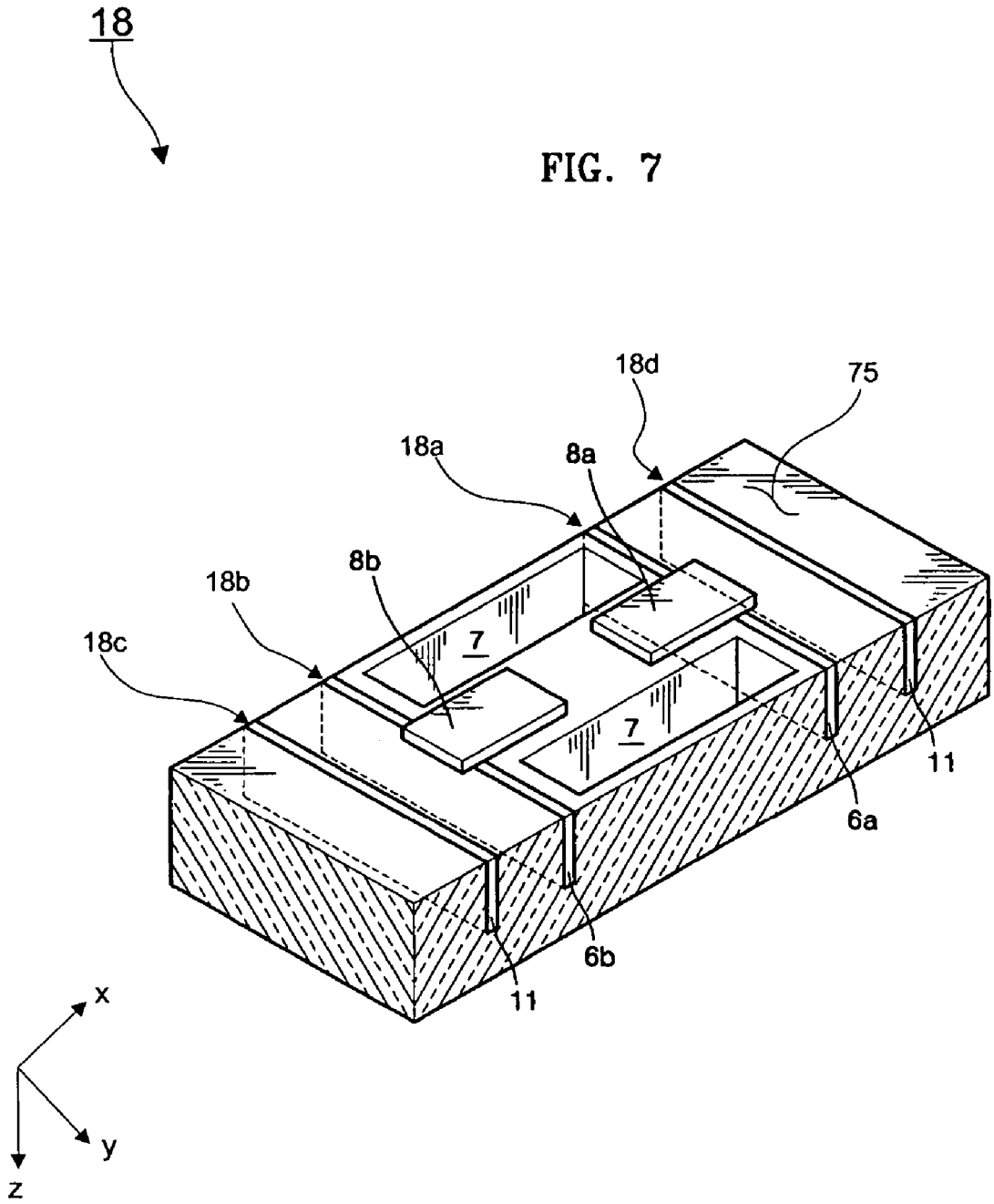
FIG. 7 is a perspective view illustrating a portion of a front plate of a plasma display according to a second embodiment of the present invention.

Turning now to FIG. 7, FIG. 7 is a perspective view illustrating an inner surface 75 side of a front plate 18 for a plasma display according to a second embodiment of the present invention. Referring to FIG. 7, a black material (BM) structure, which is in the same shape as a bus electrode, is added to the plasma display structure of the first embodiment of the present invention. In other words, BM strips 11 are formed in channels 18*c* and 18*d* in first plate 18. Like channels 18*a* and 18*b* used for the bus electrodes, channels 18*c* and 18*d* and thus the BM structure is formed in a y direction and parallel to the bus electrodes 6*a* and 6*b*. The BM strips 11 fill separate channels that are formed in the first plate 18 to a predetermined depth in the z direction. The BM strips 11 are arranged to block and absorb external light and to prevent a cross talk between unit pixels or unit discharge areas. Here, the BM strips 11 may be formed when forming the bus electrodes 6*a* and 6*b*.

As described above, the wells 7 and the channels 1*a*, 1*b* and 18*a* through 18*d* may be formed in the first plate 1 or 18 by using a conventional laser device, or may be formed by combining a first sheet, which is not processed, and a second sheet in which the wells and the channels are processed. Accordingly, the first plate according to the present invention may be formed of a single plate or more than one sheet. Thus, the scope of the present invention is not limited by the structure of the first plate or by some exact process for forming the completed first plate.

Figure 8:
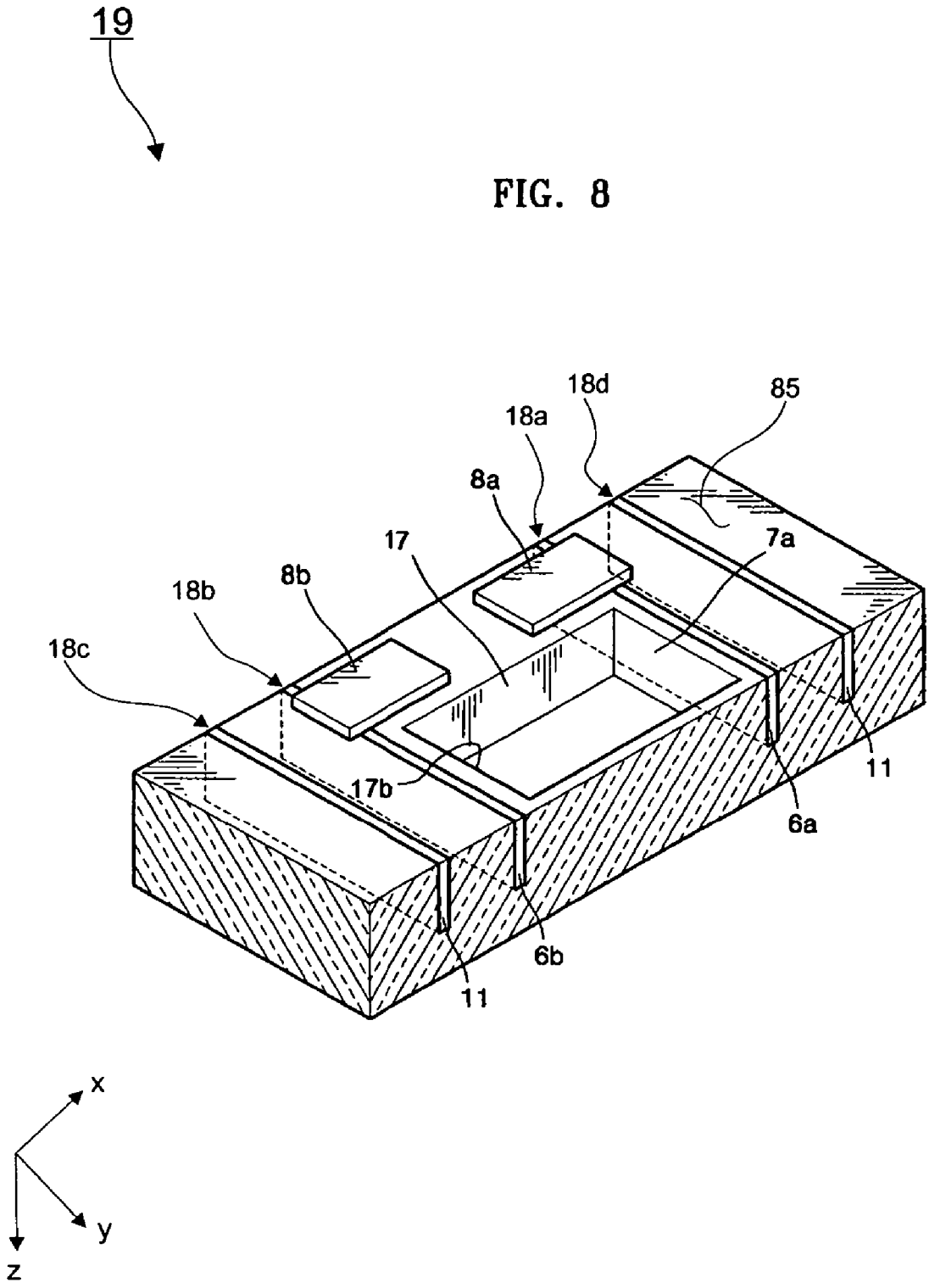
FIG. 8 is a perspective view illustrating a portion of a front plate of a plasma display according to a third embodiment of the present invention.

Turning now to FIG. 8, FIG. 8 is a perspective view illustrating an inner surface 85 side of a unit discharge area of a front plate 19 of a plasma display according to a third embodiment of the present invention. Referring to FIG. 8, only one well 17 is formed per unit discharge area. In this case, the opening area of the well 17 may be increased compared to the well 7 of the first two embodiments. Thus, a couple of sustain electrodes 8*a* and 8*b* and the well 17 are adjacent asymmetrically. As with the second embodiment, channels 19*a* through 19*d* extend in the y direction and are filled with a material. In the case of channels 19*a* and 19*b*, these channels are filled with a metal to form bus electrodes 6*a* and 6*b* respectively. In the case of channels 19*c* and 19*d*, these channels are filled with a black material 11.

Figure 9:
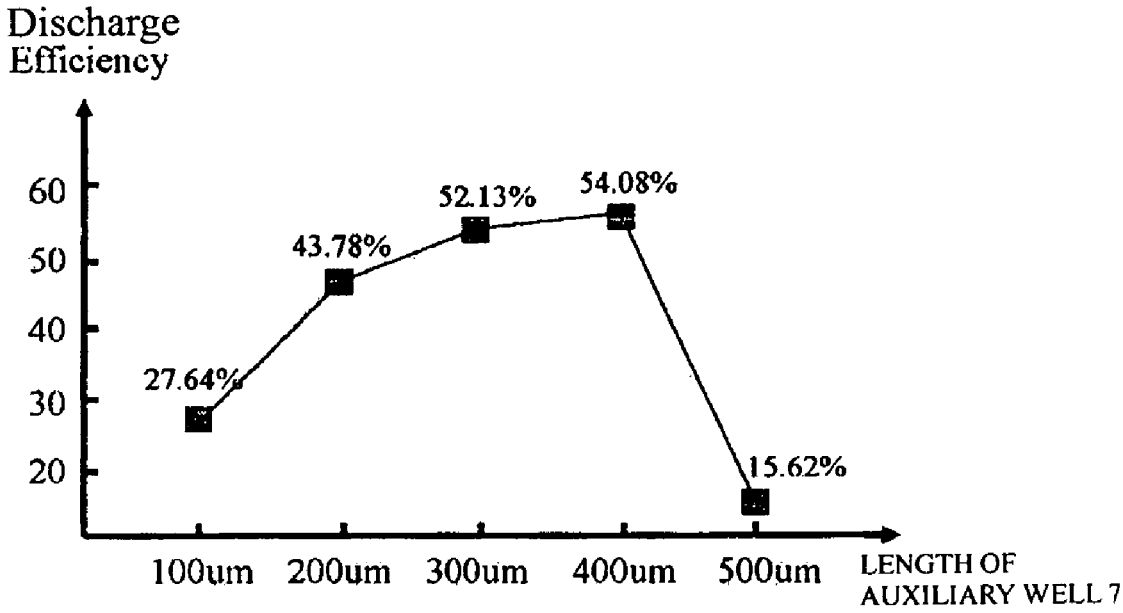
FIG. 9 is a graph illustrating changes in a discharge efficiency according to changes in an auxiliary discharge well length.

FIG. 9 is a graph illustrating changes in a discharge efficiency according to changes in an auxiliary discharge gap, in other words, a gap between the first wall 7*a* and the second wall 7*b* in the auxiliary discharge well 7. In this case, an ITO gap (the gap between electrode 8*a* and 8*b*) is 100 μm and a discharge voltage is 180V under a gas condition of Xe/Ne=5%/95% and a pressure of 500 Torr. Referring to FIG. 9, the discharge efficiency is best at a discharge gap from 300 μm to 400 μm, more specifically, 400 μm.

Figure 10:
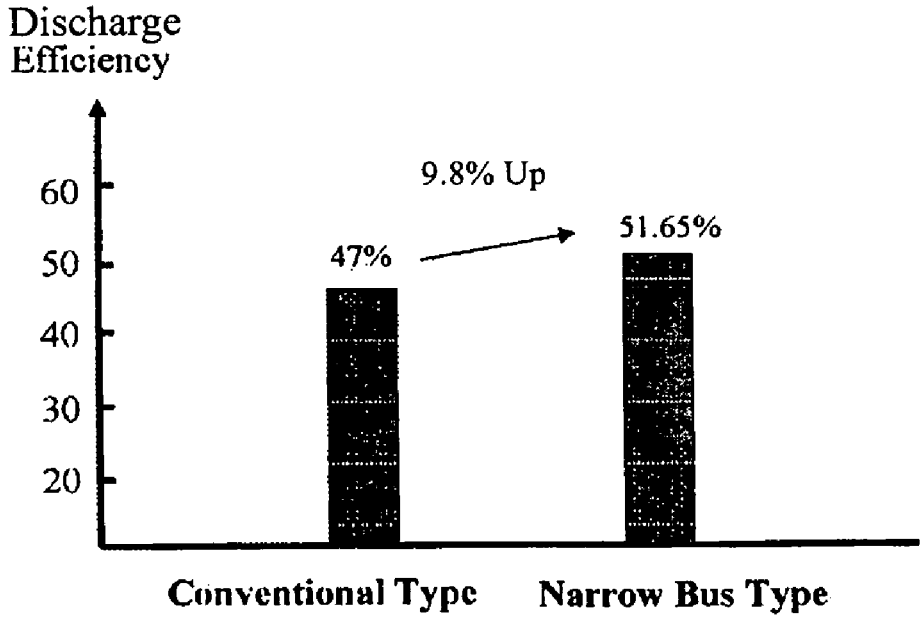
FIG. 10 is a graph illustrating discharge efficiencies of a conventional plasma display compared with a plasma display according to the present invention.

FIG. 10 is a graph illustrating discharge efficiencies of a conventional plasma display and a plasma display according to the present invention. Referring to FIG. 10, the luminescence (or discharge) efficiency of the conventional plasma display is 47%, and the luminescence efficiency of the plasma display according to the present invention is 51.65%, which is a 9.8% improvement over the conventional plasma display because 51.65/47=1.098.

Such a plasma discharge method and a plasma display using the same improve the stability and the efficiency of a sustain discharge, thereby reducing a discharge gap for an address discharge, i. e., the gap between a first plate and a second plate. As the discharge gap decreases, the height of barrier walls decreases. In addition, the reduced discharge gap lowers a breakdown voltage. Thus, a driving voltage of an address discharge drive circuit, which is necessary for a plasma display, is lowered which is economically desirable. Furthermore, visible rays that are generated from a fluorescent layer by ultraviolet rays due to a discharge can be transmitted to the outside through the first plate without significant interference from the bus electrodes. In other words, since the bus electrodes are arranged perpendicular into a substrate instead of across the substrate, an optical loss due to the bus electrodes is prevented and a surface discharge occurs by using the bus electrodes, resulting in discharge with high luminescence.

As described above, a plasma discharge method and a plasma display using the same occur a sustain discharge in a combination type of surface discharge and facing surface discharge after an address discharge. In addition, the discharges occur in different areas and priming particles generated from the discharges are exchanged. Accordingly, bus electrodes may be used as separate discharge units as well as connection units of sustain electrodes.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma discharge method, comprising:

providing a first plate and a second plate facing the first plate with a discharge gas in a space between the first plate and the second plate;

generating an address discharge between a plurality of first sustain electrodes arranged in the first plate and a plurality of address electrodes arranged in the second plate;

generating a first sustain discharge in auxiliary discharge wells formed in the first plate, the first sustain discharge being generated between a plurality of first and second bus electrodes, the first and the second bus electrodes buried in the first plate and forming surfaces that face each other, each of the auxiliary wells formed between one of the first bus electrodes and one of the second bus electrodes; and generating a second sustain discharge between the first sustain electrodes and a plurality of second sustain electrodes, both of the first and the second electrodes formed on an inner surface of the first plate, the first and the second electrodes connected to the first and second bus electrodes, respectively, the first sustain discharge being maintained during the second sustain discharge.

2. The method of claim 1, wherein the first sustain discharge and the second sustain discharge occur simultaneously and after the generating of the address discharge, wherein priming particles generated by the first sustain discharge and the second sustain discharge are exchanged.

3. The method of claim 1, wherein the first and second bus electrodes are comprised of a metal.

4. The method of claim 1, wherein the auxiliary discharge wells are arranged by forming recesses in the first plate to a predetermined depth.

5. The method of claim 1, wherein the second sustain discharge is generated in a space between the first plate and the second plate outside of the auxiliary discharge wells.

6. The method of claim 1, wherein the first and the second sustain electrodes are arranged on a portion of the inner surface of the first plate where the auxiliary wells are not formed.

7. A plasma display, comprising:

a first plate and a second plate with a main discharge area in between, the main discharge area comprising a plurality of unit discharge areas, each filled with a discharge gas;

auxiliary discharge wells corresponding to the unit discharge areas arranged in an inner surface of the first plate, each well having a bottom that is recessed in from an inner surface of the first plate to a predetermined depth, and first and second walls that face each other at opposite sides of the well;

a plurality of first and second bus electrodes buried in the first plate with the auxiliary discharge wells formed between the first and the second bus electrodes, and having planes perpendicular to the inner surface of the first plate;

a plurality of first and second sustain electrodes corresponding to the unit discharge areas and formed on the inner surface of the first plate to have planes parallel to the inner surface of the first plate, each of the first sustain electrodes connected to one of the first bus electrodes and each of the second sustain electrodes connected to one of the second bus electrodes; and a plurality of address electrodes arranged in the second plate and corresponding to the first and second sustain electrodes.

8. The plasma display of claim 7, wherein the first plate is a front plate that transmits visible rays, a fluorescent layer being arranged on an inner surface of the second plate.

9. The plasma display of claim 7, wherein a plurality of first and second channels are formed inside the first plate, the first and the second channels respectively being parallel with the first and second walls of the auxiliary discharge wells while being separated from the first and second walls by a predetermined distance, the first and second bus electrodes being respectively arranged in the first and second channels.

10. The plasma display of claim 7, wherein the first and second bus electrodes are respectively connected to the first and second sustain electrodes of the unit discharge areas, the unit discharge areas being arranged in the extending direction of the bus electrodes.

11. The plasma display of claim 7, wherein the bus electrodes are comprised of a metal.

12. The plasma display of claim 9, wherein separate channels are formed inside the first plate while being separated from the first and the second channels to a predetermined distance, and the separate channels are filled with a black matrix material for absorbing external light.

13. The plasma display of claim 7, wherein the first and the second sustain electrodes are mraitged formed on a portion of the inner surface of the first plate where the auxiliary wells are not formed.

14. The plasma display of claim 7, comprised of a dielectric layer formed on the inner surface of the first plate.

15. A plasma display, comprising:

a first plate having an inner and an outer surface;

a second plate having an inner and an outer surface, the inner surface of the first plate facing the inner surface of the second plate with a main discharge area in between that comprises a plurality of unit discharge areas, each unit discharge area being filled with a discharge gas;

a plurality of auxiliary discharge wells formed in the inner surface of the first plate, each of the plurality of auxiliary discharge wells being connected to the main discharge area and being filled with said discharge gas, each well having a first wall and a second wall opposite the first wall;

a plurality of first and second bus electrodes buried in the first plate with the auxiliary discharge wells formed between the first and the second bus electrodes, and having planes perpendicular to the inner surface of the first plate and parallel to the first and the second walls, respectively;

a plurality of first and second sustain electrodes corresponding to the unit discharge areas and formed on the inner surface of the first plate to have planes parallel to the inner surface of the first plate while being electrically connected to the first and second bus electrodes respectively; and a plurality of address electrodes arranged in the second plate and corresponding to the first and second sustain electrodes.

16. The plasma display of claim 15, wherein two wells correspond to each unit discharge area.

17. The plasma display of claim 15, further comprising black material formed in channels formed inside the first plate and running parallel to the first and the second bus electrodes.

18. The plasma display of claim 15, comprised of the main discharge area being divided into said plurality of unit discharge areas by a plurality of barrier ribs formed in a striped pattern between the inner surfaces of the first and the second plates, wherein sidewalls of the barrier ribs are coated with a layer of phosphor, the first plate being transparent to visible light.

19. The plasma display of claim 15, the distance between the first wall and the second wall for each well is at least 300 microns.

20. The plasma display of claim 15, the first and the second bus electrodes being spaced apart from each other by 400 microns.

21. The plasma display of claim 20, the distance between the first wall and the second wall for each well is 350 microns, leaving each of said first and said second wall 25 microns from the first and the second bus electrodes respectively.

22. The plasma display of claim 20, the distance between the first sustain electrode and an address electrode being less than 400 microns, the distance between the second sustain electrode and the address electrode in a unit discharge area is less than 400 microns.

23. The plasma display of claim 15, wherein the first and the second sustain electrodes are formed on a portion of the inner surface of the first plate where the auxiliary wells are not formed.

* * * * *